US006278374B1

(12) United States Patent
Ganeshan

(10) Patent No.: US 6,278,374 B1
(45) Date of Patent: Aug. 21, 2001

(54) FLAME DETECTION APPARATUS AND METHOD

(75) Inventor: Ram Ganeshan, Sugar Land, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/565,902

(22) Filed: May 5, 2000

(51) Int. Cl.[7] ..... G08B 17/12
(52) U.S. Cl. ..... 340/578; 250/554; 431/79
(58) Field of Search ..... 340/578; 431/78, 431/79; 250/554

(56) References Cited

U.S. PATENT DOCUMENTS

| | | | | |
|---|---|---|---|---|
| 2,911,540 | | 11/1959 | Powers | 250/554 |
| 3,742,474 | | 6/1973 | Muller | 340/578 |
| 3,820,097 | | 6/1974 | Larson | 307/117 |
| 4,395,638 | | 7/1983 | Cade | 250/554 |
| 4,520,390 | * | 5/1985 | Paredes | 505/445 |
| 4,591,725 | | 5/1986 | Bryant | 250/554 |
| 4,653,998 | * | 3/1987 | Sohma et al. | 431/79 |
| 4,746,178 | | 5/1988 | Canty | 362/576 |
| 4,904,986 | | 2/1990 | Pinkaers | 340/578 |
| 4,965,601 | | 10/1990 | Canty | 396/19 |
| 4,977,418 | | 12/1990 | Canty | 396/19 |
| 5,230,556 | | 7/1993 | Canty | 362/562 |
| 5,245,196 | | 9/1993 | Cabalfin | 250/554 |
| 5,300,836 | | 4/1994 | Cha | 327/113 |
| 5,510,772 | * | 4/1996 | Lasenby | 340/578 |
| 5,548,277 | | 8/1996 | Wild | 340/578 |
| 5,549,469 | | 8/1996 | Wild | 431/79 X |
| 5,952,930 | | 8/1999 | Umeda et al. | 340/579 |
| 5,993,194 | * | 11/1999 | Lemelson et al. | 431/79 X |

FOREIGN PATENT DOCUMENTS

178169 * 7/1997 (JP) .

OTHER PUBLICATIONS

Gay Engineering & Sales Company, Inc. sales literature (Aug. 24, 1998).
Honeywell Flame Safeguard Catalog (1996) p. 42.

* cited by examiner

*Primary Examiner*—Thomas Mullen
(74) *Attorney, Agent, or Firm*—Kellogg Brown Root, Inc

(57) ABSTRACT

The present invention relates to flame detection apparatus and method. The present invention provides a method and apparatus for monitoring the status of a combustion unit having at least one bumer. Initially, a digital image of a flame corresponding to a flame is acquired. Next, a value for the relative light intensity of a frame defining an area of the image corresponding to the flame for the burner is calculated. The relative light intensity value is compared against a tolerance range for the frame. If the relative light intensity value is outside the tolerance range then an alarm state output is generated.

17 Claims, 4 Drawing Sheets

FLAME DETECTION APPARATUS AND METHOD

FIELD OF THE INVENTION

The present invention relates to a flame detection apparatus and method. More specifically, the present invention relates to a flame detection apparatus and method designed for monitoring a plurality of flames in a combustion unit such as an industrial furnace or ground flares.

BACKGROUND OF THE INVENTION

Numerous industrial processes utilize combustion units, such as, for example, furnaces, ovens, incinerators, driers, boilers, flares, heated baths, and the like. The combustion units typically have multiple bumers. Each of the burners produces a flame from combustion of a fuel, such as, for example, gas, oil, coal, coke, or the like, with air, oxygen, oxygen-enriched air, or the like. The burner flames can be ignited by an associated pilot flame. In the event of a flame failure, the fuel and air supplied to the burner must be stopped to avoid a buildup of fuel in the unit, which might otherwise result in possible uncontrolled combustion or explosion. To accomplish the burner shut down, the combustion unit generally has a control system associated with each bumer, which uses a flame sensing apparatus and flame sensor circuitry for sensing the presence of the flame. Upon detecting the absence of a flame within the unit the flame sensor transmits a signal through the sensor circuitry to the burner control system that shuts the burner down. When one of the burners has been shut down, but more commonly after several of the burners have been shut down, depending on the operating characteristics of the combustion unit, the entire combustion unit is shut down primarily to prevent a hazardous situation, as well as for maintenance and repair of the improperly functioning bumers.

To present, the principal types of flame sensing transducers have been devices using the photoelectric effect, photosensitive conductors, and flame rods. Devices using the photoelectric effect generate an electrical voltage when a material is exposed to light. Photoelectric detectors are not restricted to sensing visible light, as they can be made to respond to infrared and ultraviolet radiation. Depending upon the amount of illumination detected, the photoelectric detectors send a voltage (or current in an attached circuit) of corresponding magnitude. Devices using this effect are known as photocells, photovoltaic cells, photosensors, or light-sensitive detectors. Examples of such devices are found in U.S. Pat. No. 5,245,196 to Cabaffin, U.S. Pat. No. 4,904,986 to Pinkaers, U.S. Pat. No. 4,591,725 to Bryant, U.S. Pat. No. 4,395,638 to Cade, U.S. Pat. No. 3,820,097 to Larson, and U.S. Pat. No. 3,742,474 to Muller.

Devices using the photoelectric effect have several disadvantages. The sensors are adversely affected by any dust accumulating thereon and must be periodically purged with air to remove the dust. Further, the sensors must be positioned in close proximity to the burner, and as a consequence are generally required to withstand the high-temperature environment and be explosion proof. Additionally, the sensors must be switched out if the fuel supply is changed. For example, if switching fuels from gas to oil, the sensors must usually be changed to detect the different corresponding visible, ultraviolet, or infrared spectra associated with the particular fuel.

Photosensitive conductors use compounds such as cadmium sulfide and cadmium selenide that are electrically sensitive to the flame. Such compounds decrease in resistance when exposed to light. One example of a device using photosensitive conductors is U.S. Pat. No. 2,911,540 to Powers. The photosensitive conductor is connected through a high resistance to a direct voltage source in such a manner that when and as the intensity of the radiation increases, the voltage across the conductor decreases. The voltage drop across the conductor is measured and a system shut down is performed depending upon predetermined voltage levels.

Flame rods use the flame conductivity as a detection means. The flame rod is placed in direct contact with the flame produced on a burner and a voltage is applied between the flame rod and the bumer. A current results between the flame rod and the burner due to the presence of charged particles in the flame. The current is dependent upon conditions of combustion such as input rate and air-to-fuel ratio. Measuring the current levels with the flame rods enables the detection of flame malfunction. Examples of flame rods are found in U.S. Pat. No. 5,300,836 to Cha, the 1996 Honeywell Flame Safeguard Catalog and sales literature from Gay Engineering & Sales Company, Inc.

Systems using flame rods have inherent disadvantages associated with the thermal degradation of the rod itself. Because the tip of the flame rod remains in constant contact with the flame produced by the burner or pilot flame, the flame rod is subjected to constant thermal degradation. Depending upon the type of flame rod used, the combustion characteristics and flame temperature, the life span of the flame rod may be as little as 6 months. Thus, a change in current level associated with the flame rod circuitry may be the result of the degradation of the flame rod itself, rather than any change in the flame. Additionally, because the flame rods have a relatively short life span, the combustion unit must either be periodically shut down to replace the flame rods or the operator must wear a thermally protective suit to change out the flame rod while the furnace remains on line.

To overcome the above disadvantages of relying upon a single sensor such as a flame rod, many systems use more than one type of flame sensing transducer. For example, flame rods are used to monitor pilot flames, while ultraviolet and/or infrared transducers are used to simultaneously monitor main burners. Systems incorporating more than one type of flame sensing transducer are shown in U.S. Pat. No. 5,952,930 to Umeda et al., and U.S. Pat. Nos. 5,549,469 and 5,548,277, both to Wild.

All of the abovementioned flame sensing transducers, and systems of the same, have the common disadvantage of requiring multiple sensing devices for multiple burners. In other words, each flame monitoring device is capable of monitoring only a single bumer. If, for example, there are eight burners within the combustion unit, then there must also be eight flame sensing transducers.

There exists, therefore, a need for a flame detection apparatus and method which can utilize a single flame sensing apparatus to detect failure of multiple burners.

SUMMARY OF THE INVENTION

The present invention relates to a flame detection apparatus and method. The present system uses a digital camera, for example, positioned to acquire a digital image of a plurality of the flames in a combustion unit. The digital image is segregated into different frames, wherein each frame corresponds to a flame associated with a particular bumer. By measuring the lighted area of the frame, and comparing this to a normal or other reference flame measurement, an output signal indicative of the relative flame intensity can be produced for each burner or flame. The flame detection system is self-checking, since the indication of other flames and/or a visual check of the digital image verifies that the device is functioning properly. Moreover, the digital camera can be positioned at a sight glass or glasses through which the flames can be collectively viewed, and thus protected from the high temperatures within the furnace.

A preferred embodiment of the present invention provides a method for monitoring the status of a combustion unit having at least one burner. A digital image of a flame corresponding to a flame is acquired. A value for the relative light intensity of a frame defining an area of the image corresponding to the flame for the burner is calculated. The relative light intensity value is compared against a tolerance range for the frame. If the relative light intensity value is outside the tolerance range, then an alarm state output is generated.

Another preferred embodiment of the present invention provides a method for monitoring the status of a combustion unit having a plurality of burners. A digital image of a plurality of flames corresponding to the burners is acquired. An array of light intensity values for the plurality of frames is calculated, with each frame defining an area of the image corresponding to the flame for one of the burners. The relative light intensity values are compared against a tolerance range for each frame. If the relative light intensity value is outside of the tolerance range, then an alarm state output is generated.

Yet another preferred embodiment of the present invention provides an apparatus for monitoring the status of a combustion unit having a plurality of burners. The apparatus comprises a digital camera, a computer, and an alarm system. The digital camera is positioned adjacent the combustion unit for acquiring a digital image of a plurality of flames corresponding to the burners. The computer, operatively coupled with the camera, receives the digital image. The computer is programmed to calculate an array of light intensity values relative to a baseline light intensity value for a plurality of frames. Each frame defines a sub-area of the digital image corresponding to the flame for one of the burners. The computer then compares the relative light intensity values against a tolerance range for each frame and generates an alarm state output for each relative light intensity value that is outside the tolerance range. The alarm system is activated by the alarm state output.

Other features, and the advantages, of the present invention will be made clear to those skilled in the art by the following detailed description of the preferred embodiments constructed in accordance with the teachings of the present invention.

DETAILED DESCRIPTION

In the following detailed description of the preferred embodiments of the flame detection apparatus and method, the invention is described as being installed for use on a multi-flame furnace. The present invention is not, however, restricted to such applications. Those skilled in the art will recognize that the present invention may be used to advantage for any number of industrial process units or combustion units such as, for example, ovens, driers, boilers, incinerators, flares or heated baths. Further, the present invention is not restricted to monitoring burners enclosed within contained combustion units, but can be used to monitor other flame generating devices such as ground-level flares. However, for purposes of illustration and not for limitation, the present invention will be described with reference to a multi-bumer furnace.

Figure 1:
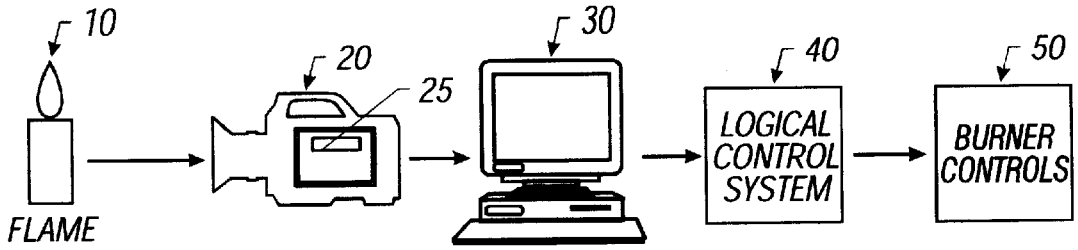
FIG. 1 is a schematic overview of a preferred embodiment of the flame detection apparatus and method of the present invention.

FIG. 1 is a schematic overview of a preferred embodiment of the flame detection apparatus and method of the present invention. In the schematic, the flame 10 is representative of one or more flames within a multi-burner furnace, for example. An Optical Data Acquisition Device (ODAD) 20 acquires a digital image of the flame 10. In a preferred embodiment of the present invention, the ODAD 20 is a digital video camera. However, one skilled in the art will recognize that devices such as digital cameras programmed to acquire digital images could also be used to advantage as the ODAD 20 and remain within the purview of the invention. It is further noted that the ODAD can acquire digital images outside the visible spectrum, for example, ultraviolet or infrared spectra can be acquired as a digital image. All spectra by which the presence, absence or intensity of a flame can be differentiated, whether visible light, infrared or below, or ultraviolet or above, are included within the definition of "optical data" for the purposes of the present specification and claims.

It should be understood that the term "digital image" as used herein is not limited to a visual image or an image projected onto a monitor or screen. Rather, the term "digital image" encompasses visual images, digital databases, and digital data converted to analog signals that can be transmitted for analysis.

The digital image is acquired, or captured, by the ODAD 20 on a conventional image capture card 26 within the ODAD 20. The captured digital image is transmitted from the capture card 25 to a computer 30 having special imaging analysis software. It should be understood that the term "computer" as used herein is only representative of a device capable of interacting with the imaging analysis software to receive and analyze the digital image and transmit a signal based upon the analysis. In a preferred embodiment of the present invention, the digital image is transmitted to the computer 30 through a network connection such as a hard-wired electrical or optical connection. However, one skilled in the art will recognize that the image can likewise be transmitted to the computer 30 at a remote location through an Internet connection, modem connection, satellite system, cable system, wireless LAN or WAN system, cellular system, or the like, or any combination of these data transmission channels and modes.

Figure 2:
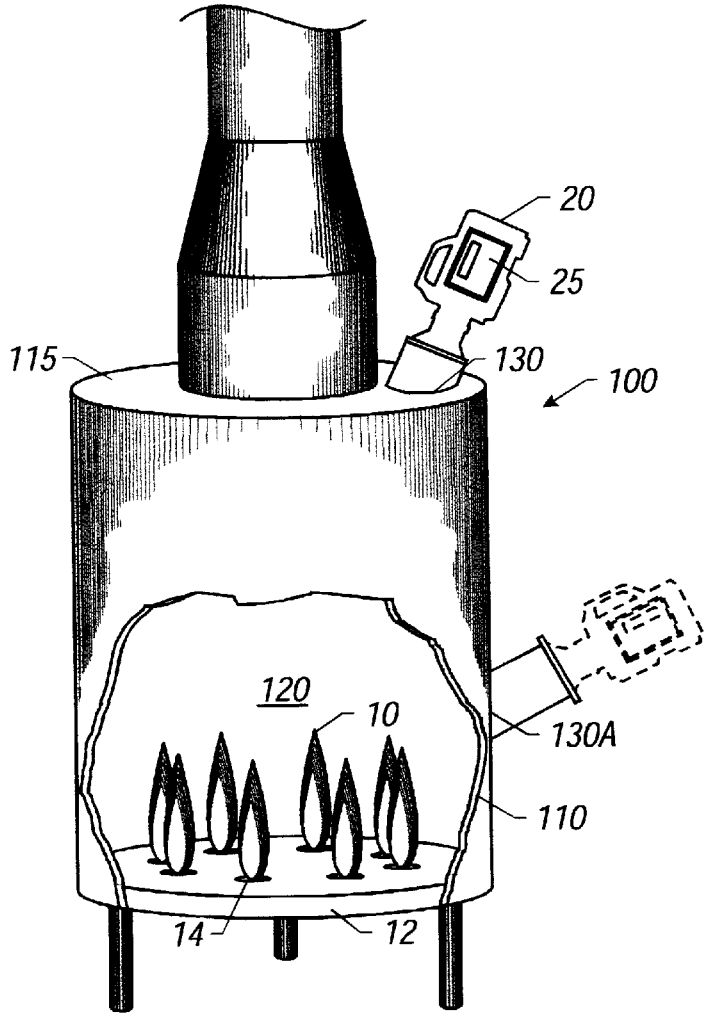
FIG. 2 is a perspective view, partially cut away, of an Optical Data Acquisition Device (ODAD) mounted to a combustion unit according to the present invention. The combustion unit is a furnace with a plurality of burners.
Figure 3:
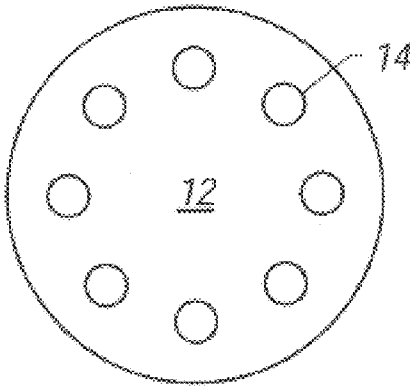
FIG. 3 is a plan view of the bumer plate of the combustion unit of FIG. 2.

The computer 30 with the imaging analysis software analyzes the received digital image and compares the signals with the histograms of the flame 10 and detects the flame status. In the event that the flame 10 has malfunctioned, a failure signal is transmitted to a logical control system 40 to implement corrective flame safety and/or unit or fuel shut down functions. In a preferred embodiment of the present invention, the logical control system 40 is a programmable logic controller (PLC) that operates the burner controls 50 and optionally operates related equipment within a plant or process. Additionally, in a preferred embodiment of the present invention the failure signal is transmitted to the logical control system 40, which comprises a distributed control system (DCS) operating the substantial whole of the plant or process unit of which the burner and flame 10 are a part. It should be noted that one skilled in the art will recognize that the failure signal can also be transmitted to a wireless communication device such as a cellular phone, pager or beeper, in order to notify an operator of the equipment FIG. 2 is a perspective view of an ODAD 20 mounted to a combustion unit 100, namely a furnace having a plurality of burners 14, according to the principles of the present invention. As shown by the cut-away portion of the combustion unit 100, the combination of the exterior wall 110 and the arch of the unit 100, which can be refractory-lined, defines an interior chamber 120. Within the interior chamber 120 is a burner plate 12 having a plurality of burners 14 producing a plurality of flames 10. It should be noted that although the combustion unit 100 shown is a cylindrical furnace, this is merely for purposes of illustration, and one skilled in the art will recognize that the combustion unit 100 could have a cabin with a square, rectangular, or any other regular or irregular shaped footprint and remain within the purview of the invention. FIG. 3 is a plan view of the burner plate 12 showing a circular orientation of eight (8) burners 14. However, one skilled in the art will recognize that the burner plate 12 can have any number of burners 14 orientation in any number of ways depending upon the particular application. The burners can be arranged in any conventional layout on the floor, walls, ceiling or the like, e.g. in rows or other regular patterns, or a random pattern. All such changes to the burner plate 12 are intended to fall within the purview of the present invention.

Referring back to FIG. 2, in a preferred embodiment of the present invention, the ODAD 20 is positioned adjacent the combustion unit 100. As stated above, the ODAD 20 in a preferred embodiment is a digital video camera. The ODAD 20 is mounted to a sight glass 130 through which the flames 10 within the furnace can be seen. The sight glass 130 is located on the arch 115 of the combustion unit 100. The ODAD 20 is mounted using methods well known in the art of mounting a camera to a sight glass 130. Specific examples of such mountings are known from U.S. Pat. Nos. 5,230,556, 4,977,418, 4,965,601, and 4,746,178 to Canty, for example, all of which are hereby incorporated by reference herein.

The ODAD 20 is positioned to capture a digital image encompassing all of the burners 14 within the combustion unit 100. Although FIG. 2 illustrates the ODAD 20 mounted on the arch 115 of the combustion unit 100, one skilled in the art will recognize that the ODAD 20 can be mounted to a sight glass 130A located on the exterior wall 110 of the combustion unit 100 (as indicated by the dashed lines) and still remain within the purview of the invention. The scope of the mounting locations of the present invention is only limited by those locations enabling simultaneous image capture of a plurality of the burners 14. If needed, depending upon the number of burners 14 viewed, the ODAD 20 may be equipped with a wide-angle lens. Alternatively or additionally, digital images corresponding to different ones of the flames 10 can be captured by two or several ODAD's 20 positioned in different places, for example, if the image of all of the flames 10 cannot be captured conveniently by a single ODAD 20, or if redundancy is desired.

As discussed above, digital images of the flames 10 acquired by the ODAD 20 are transmitted from the capture card 25 to a computer having special imaging analysis software. The software analyzes the received digital image and generates at least an alarm output, but can also generate a visual output, a separate analog or digitized output, or any combination of these.

Figure 4:
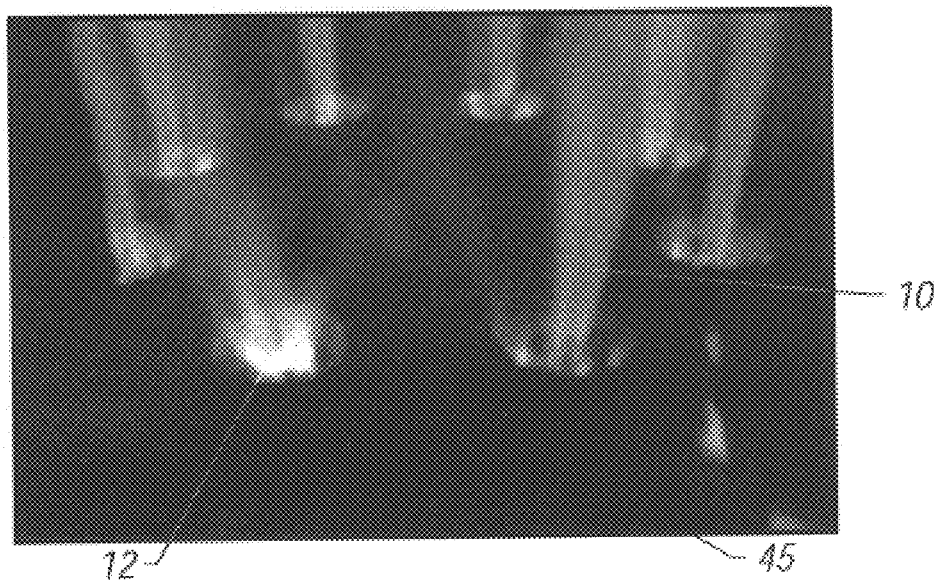
FIG. 4 illustrates an initial captured digital image of the flames within the combustion unit of FIGS. 2–3.
Figure 5:
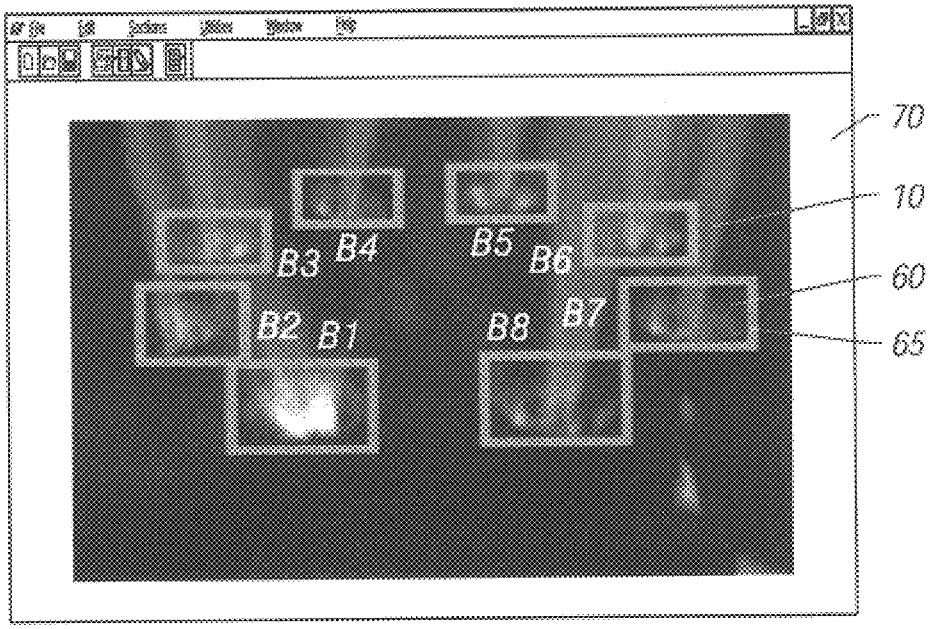
FIG. 5 illustrates the captured digital image of FIG. 4 divided into distinct sections or frames by the image analysis software.

FIG. 4 shows an initial captured digital image 45 of the flames 10 within a combustion unit (not shown). The initial captured image 45 is taken with the burners 12 in their correctly functioning condition. The initial captured image 45 is transmitted to the computer 30 for analysis by the image analysis software. As shown in FIG. 5, the image analysis software divides the digital image into distinct sections, or frames 60 (labeled B1–B8), and generates a display of the image on an output screen 70 with status bars 65 inserted around each frame 60. The digital image is divided into the distinct frames 60 that correspond to the number of flames 10. The frames 60 can be square, rectangular, circular or have another regular or irregular shape circumscribing the general illuminated area of the digital image 45 corresponding to each of the flames 10. For example, the frames 60 can be defined by tracing around the illuminated areas corresponding to each flame 10 using a touch-screen input-output device coupled to the computer. Thus, if the combustion unit 100 is an eight-bumer furnace, then the initial captured image 45 is divided into eight distinct frames 60, with each individual frame 60 corresponding to an individual flame 10 and circumscribing that portion of the digital image 45 illuminated relatively more intensely thereby.

After dividing the image into distinct frames 60, the image analysis software calculates a value for the relative light intensity of each frame 60. The values of the light intensity are stored in an array representing the plurality of frames 60. A suitable tolerance (e.g. 15%) is applied to each of the calculated relative light intensity values to allow for minor deviations in the flame intensity of each individual flame 10 corresponding more or less to normal fluctuations. The application of the tolerance to each calculated relative light intensity value yields a tolerance range, or baseline frame, used for comparisons with subsequently received digital images of the same combustion unit. It should be noted that if the image received by the image analysis software is in the form of a digital or analog signal, rather than a visual image, the flame intensity is computed with reference to the number of lighted pixels for each frame 60, for example, or the sum of the pixel intensity values for each pixel if the ODAD/software is capable of this function.

Subsequent digital images of the combustion unit are transmitted to the computer at predetermined intervals. It should be noted that the intervals may be in small increments (i.e., less than one second) to effectively enable constant real time monitoring of the unit Upon receipt of the subsequent images by the image analysis software, the software divides the image into frames 60 corresponding to the initial captured image and computes the relative light intensity for each frame 60. The computed light intensity is compared against the tolerance range, or baseline frame. Baseline light intensity values can be set when the furnace is initially brought on line and is functioning properly, so that computed light intensities corresponding to the baseline will have a relative reading of 1. If the value of the relative light intensity exceeds the tolerance range, e.g. less than 0.85 or more than 1.15, then an alarm output signal is generated. It should be noted that the term "exceeds" when used herein with respect to the tolerance range indicates that the computed relative light intensity does not fall within the tolerance range. Whether the computed light intensity is greater than or less than the tolerance range, it is considered to "exceed" the tolerance range.

Figure 6:
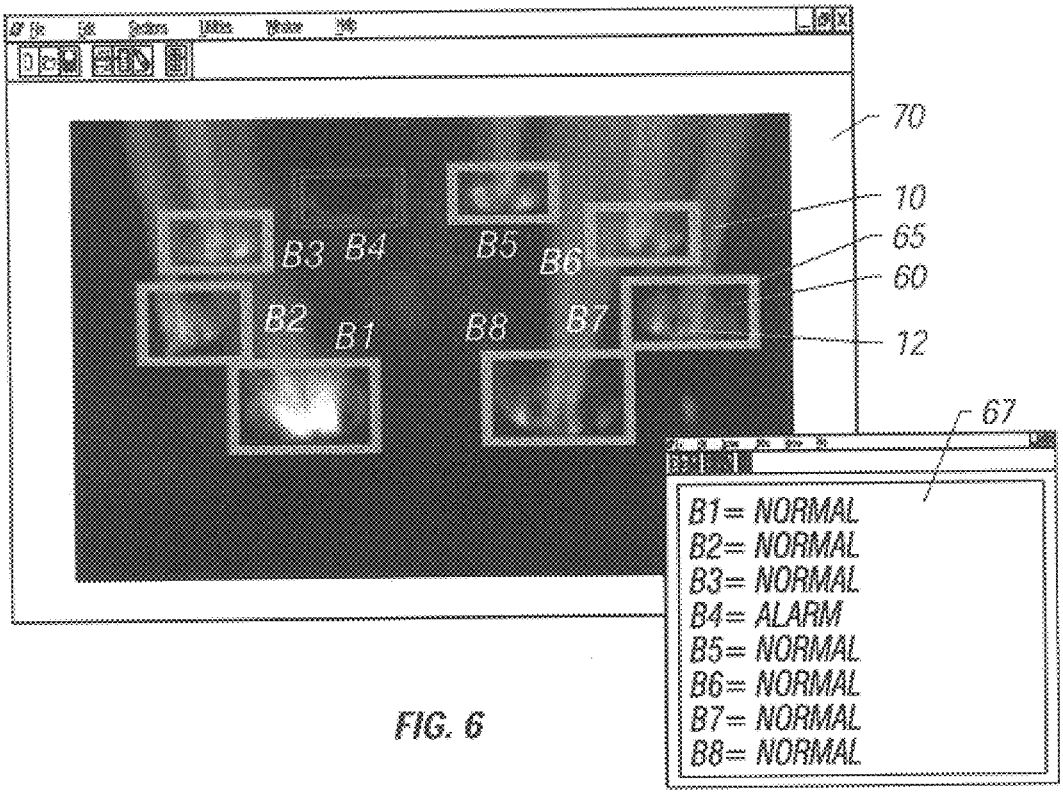
FIG. 6 illustrates the output screen provided by the image analysis software of FIG. 5 indicating flame failure.

FIG. 6 illustrates the output screen 70 provided by the image analysis software indicating flame failure. As shown, the burner 12 within the frame 60 labeled as B4 has a malfunctioning flame 10. Consequently, the computation of the relative light intensity of the frame 60 labeled B4 results in a value that exceeds the tolerance range. In a preferred embodiment of the present invention, the image analysis software provides a visual image by superimposing an alarm state display over the output screen 70. In a preferred embodiment, the alarm state display provides highlighting of the border 65 around the frame 60 with the malfunctioning flame 10. Examples of highlighting include coloring the affected frame 60 in red or causing the frame 60 to flash. Additionally, the alarm state display superimposes a text box 67 over the output screen 70 that provides a textual warning of the affected frame 60.

Referring back to FIG. 1, in a preferred embodiment of the present invention, in the event that a flame 10 has malfunctioned, a failure signal is transmitted to or generated by a logical control system 40 to implement corrective flame safety and/or unit or fuel shut down functions. It should be understood that the failure signal transmitted to the logical control system 40 can be independent of or in combination with the alarm state display provided by the output screen 70 of FIG. 6. As again emphasized, the display of the video image is not necessary for the present system to function.

In another preferred embodiment of the present invention, the image analysis software additionally provides general status displays. In this preferred embodiment, the general status display is provided on the output screen 70 by superimposing a visual gauge adjacent each frame 60 indicative of the difference between the calculated relative light intensity and the tolerance range. Alternatively, this difference can be displayed in a gauge, dial, digital or similar readout (not shown) in lieu of or in addition to the output screen 70.

Figure 7:
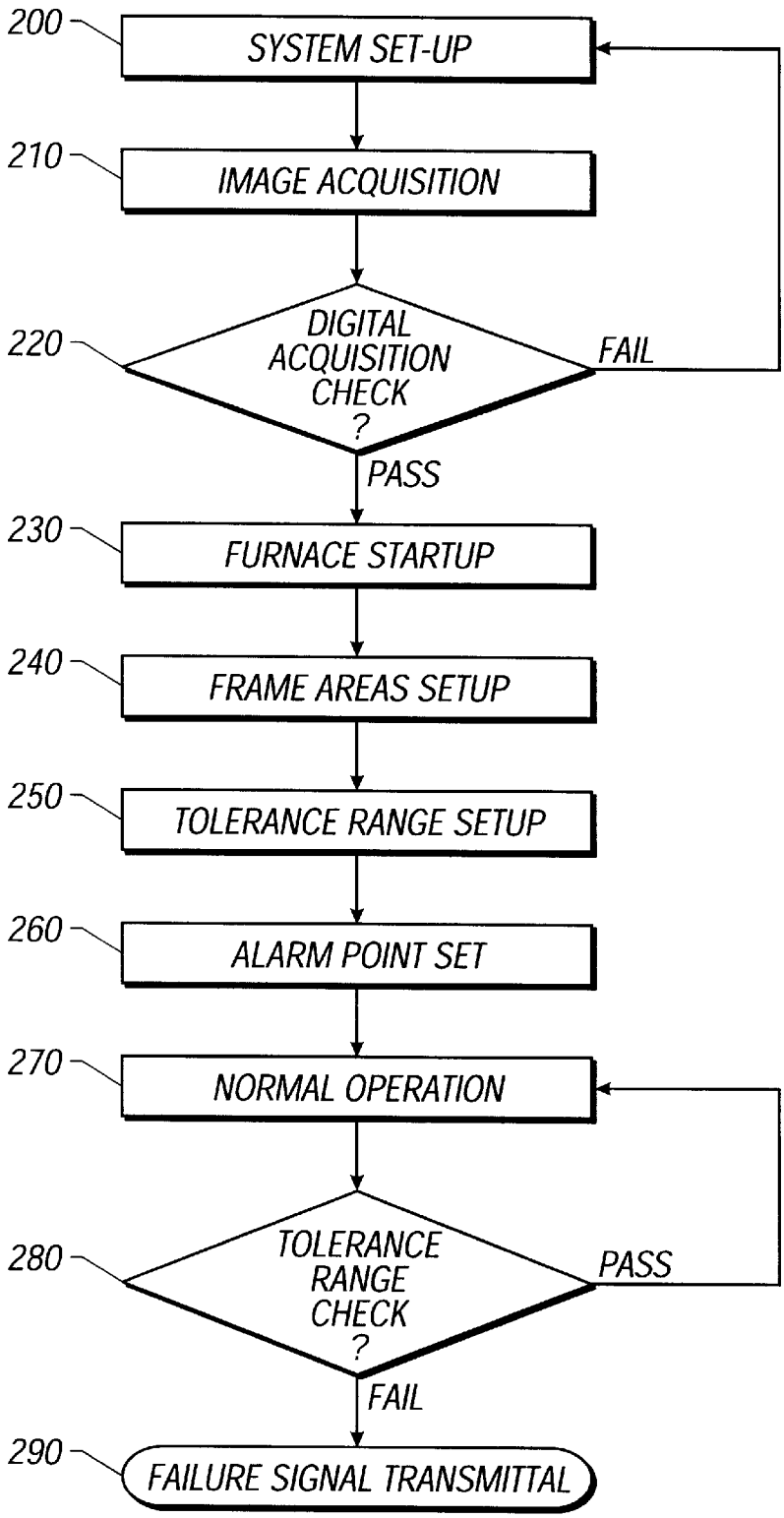
FIG. 7 is a flow diagram illustrating the sequence of events for setting up, monitoring and implementing the alarm functions in connection with the ODAD.

FIG. 7 is a flow diagram illustrating the sequence of events in a preferred embodiment of the present invention for setting up, monitoring and implementing the alarm functions in connection with the ODAD. The flow diagram is described with reference to implementation of the present invention upon a furnace, however, as discussed above the present invention can be used to advantage on any number of process units or combustion units. System set-up 200 requires that the ODAD be mounted on the sight glass of the furnace. As discussed above, the ODAD is mounted using methods well known in the art of mounting a camera to a sight glass. Additionally during system set-up 200, the computer and control system is installed. As discussed above, in a preferred embodiment of the present invention, the computer, as installed, is connected to the ODAD through a network connection such as a hardwired electrical or optical connection. The control system of the computer is the imaging analysis software that controls the processing of the images and the transmission of failure signals.

During image acquisition 210, a digital image of the furnace is captured by the ODAD. The image captured by the ODAD is examined by the digital acquisition check 220. The digital image is examined to determine whether all areas of expected flames near the burners to be monitored are captured. If they are not all captured, the image acquisition 210 has failed and additional system set-up 200 is required. If all of the expected flame areas are captured, then the image acquisition 210 has passed and furnace startup 230 occurs. Furnace startup 230 results in the normal operational mode of the furnace being established.

Once the furnace is in its normal operational mode, frame area setup 240 takes place. During frame area setup, the captured digital image is divided into distinct frames circumscribing the general illuminated area of the flames. Each frame corresponds to a particular flame generated by the burners of the furnace. In a preferred embodiment of the present invention, the frames are defined by tracing around the illuminated areas corresponding to each flame using a touch-screen input-output device coupled to the computer. However, one skilled in the art will recognize that the frames can be defined by the image analysis software based upon the number of light pixels corresponding to each flame.

The image analysis software performs the tolerance range setup 250 based on the current readings (i.e. normal operation). During the tolerance range setup 250, the image analysis software calculates a value for the relative light intensity of each frame. The calculated value is the baseline light intensity value for that frame. A suitable tolerance range (e.g. 15%) is applied to the baseline light intensity value of each frame. One skilled in the art will recognize that the low endpoint of the tolerance range does not need to be the same as the upper endpoint of the tolerance range. For example, the upper endpoint could be set to 150% of the baseline light intensity value while the lower endpoint is set to 15%. Such set point percentages could depend upon the operating range of the burner's fuel release capacity. It is further contemplated that the set points can be automatically adjusted to take into account any adjustments by the operator of the firing rate of the burners.

To ensure a suitable tolerance range has been established by the tolerance range setup 250, the burner rates for each flame are increased to the maximum firing rate and checked to see if the light intensities remain inside the tolerance range. Similarly, the burner rates for each flame are decreased to the minimum firing rate and checked to see if the light intensities remain inside the tolerance range.

Once the tolerance range has been set properly, the alarm point set 260 is performed. The alarm point set 260 establishes alarm triggers at the upper and lower endpoints of the tolerance range. In a preferred embodiment of the present invention, a major alarm trigger is established at the upper endpoint of the tolerance range while a lower level alarm trigger is established at the lower endpoint to generate a low level alarm status indicating minor burner malfunctions or flame changes. However, one skilled in the art will recognize that major alarm triggers can be established at both the upper and lower endpoints.

After the alarm point set 260 has established the alarm triggers, the furnace resumes normal operation 270. The ODAD captures subsequent images of the flames near burners at regular intervals. The intervals of image capture can be at frequencies less than one second to provide real time monitoring of the flames. The tolerance range check 280 continuously compares the light intensity of the subsequently captured images with the established tolerance range. As long as the light intensity values of the subsequently captured images remain within the tolerance range, the furnace continues its normal operation 270. However, if a light intensity value of an image exceeds the tolerance range (i.e. exceeds an alarm trigger), the image analysis software performs an additional check of a subsequent image to verify that the exceedance is not transitory. If the exceedance is not transitory, the image analysis software performs a failure signal transmittal 290.

The failure signal transmittal 290 depends upon the type of failure occurring. The image analysis software initially determines whether the flame failure is limited to one flame or a plurality of flames. If more than one flame is in an alarm state the logical control system will decide at what failure level (i.e. how many flames have failed) the combustion unit is unsafe to operate. For example, in a combustion unit having eight (8) burners, the logical control system may be programmed to consider that the failure of three (3) burners creates an unsafe condition. Thus, if only two (2) burners have failed, the logical control system can leave the system operational. However, upon failure of a third bumer, the logical control system can decide that the combustion unit may be unsafe. It should be noted that the failure level at which the logical control system makes such determination is controlled on a case-by-case basis by the engineers designing and/or operating the plant. Upon deciding that the combustion unit may be unsafe, the logical control system generates and transmits a failure alarm signal that can trigger remedial measures by the burner controls and/or the DCS or PLC. Such measures include, but are not limited to, shut down of the fuel to the affected burners or to the entire furnace. If only one flame is in an alarm state, a single flame failure alarm signal is generated and transmitted which can include audible and/or visual signals that are activated until reset by the operator or the alarm condition subsides. Additionally, the transmitted signal can trigger remedial measures by the burner controls and/or the DCS or PLC. Such measures include, but are not limited to, shut down of fuel to affected burners and/or increasing fuel supply to other burners or reducing the charge rate to compensate for the loss of the affected bumer(s).

It should be noted that in addition to actions taken upon alarm state events, the present system can also be used as a controller of the furnace. Through its light intensity calculations, the image analysis software can determine relative drops or increases in light intensity for each individual flame. The image analysis software can be then be used to transmit a signal to the burner controls to increase or decrease the fuel supply to the individual burners to maintain the light intensity for that burner at a set level.

Although described in terms of the preferred embodiments shown in the figures, those skilled in the art who have the benefit of this disclosure will i recognize that changes can be made to the individual component parts thereof which do not change the manner in which those components function to achieve their intended result. For example, altering the type of ODAD used to capture the image is a change intended to fall within the scope of the following non-limiting claims.

What is claimed is:

1. A method for monitoring the status of a combustion unit having at least one burner, comprising the steps of:

(a) acquiring a digital image of a flame corresponding to the burner;

(b) calculating a value for the relative light intensity of a frame defining an area of the image corresponding to the flame for the burner;

(c) comparing the relative light intensity value against a tolerance range for the frame;

(d) generating an alarm state output if the relative light intensity value is outside said tolerance range.

2. The method of claim 1 wherein the area of the frame is substantially less than a total area of the image.

3. The method of claim 1 further comprising generating a display of the digital image.

4. The method of claim 3 further comprising operatively coupling said alarm state output with said display to superimpose an alarm state display over said image in the display.

5. A method for monitoring the status of a combustion unit having a plurality of burners, comprising the steps of:

(a) acquiring a digital image of a plurality of flames corresponding to the burners;

(b) calculating an array of relative light intensity values for a plurality of frames, each frame defining an area of the image corresponding to the flame for one of the burners;

(c) comparing the relative light intensity values against a tolerance range for each frame;

(d) generating an alarm state output for each relative light intensity value that is outside said tolerance range.

6. The method of claim 5 wherein the combustion unit comprises a multi-burner furnace.

7. The method of claim 6 wherein the image is acquired by a digital camera operatively mounted on a sight glass through which the flames in the furnace can be seen.

8. The method of claim 5 wherein the image is acquired by a digital camera positioned to view the flames.

9. The method of claim 5 wherein each relative light intensity value is relative to a light intensity of a baseline frame for a normal flame for each respective burner.

10. The method of claim 5 further comprising generating a display of the digital image.

11. The method of claim 10 further comprising superimposing outlines in said display corresponding to said frames.

12. The method of claim 11 further comprising the superimposing an alarm state image in said display for each alarm state output.

13. The method of claim 11 further comprising displaying the outlines in a first visual mode for each frame corresponding to a relative light intensity value within said tolerance range, and in a second visual mode contrastingly different from said first visual mode for each frame corresponding to an alarm state output.

14. The method of claim 5 wherein a series of the digital images are acquired at periodic time intervals and steps (b) through (d) are repeated for each digital image.

15. The method of claim 14 wherein the periodic time intervals are regular and wherein each is less than one second.

16. Apparatus for monitoring the status of a combustion unit having a plurality of burners, comprising:

a digital camera positioned adjacent the combustion unit for acquiring a digital image of a plurality of flames corresponding to the bumers;

a computer operatively coupled with the camera to receive the digital image, said computer programmed to (1) calculate an array of light intensity values relative to a baseline light intensity value for a plurality of frames, each frame defining a sub-area of the digital image corresponding to the flame for one of the burners, (2) compare the relative light intensity values against a tolerance range for each frame, and (3) generate an alarm state output for each relative light intensity value that is outside the tolerance range;

an alarm system activated by the alarm state output.

17. The apparatus of claim 16 wherein the combustion unit comprises a furnace and the camera is mounted to a sight glass.

* * * * *